United States Patent [19]

Dietrich

[11] Patent Number: 4,921,290

[45] Date of Patent: May 1, 1990

[54] BACKSET ADJUSTABLE DOOR LATCH

[75] Inventor: Hagen Dietrich, Delta, Canada

[73] Assignee: Masco Building Products Corp., Taylor, Mich.

[21] Appl. No.: 267,200

[22] Filed: Nov. 4, 1988

[51] Int. Cl.[5] ..... E05C 1/16

[52] U.S. Cl. ..... 292/337

[58] Field of Search ..... 292/337, DIG. 60, 169.14, 292/169.23, 1, DIG. 74; 70/134

[56] References Cited

U.S. PATENT DOCUMENTS

| | | | |
|---|---|---|---|
| 3,790,196 | 2/1974 | Sanders et al. | 292/337 X |
| 3,799,592 | 3/1974 | Babb, Jr. et al. . | |
| 3,799,593 | 3/1974 | Dielman . | |
| 4,060,267 | 11/1977 | Monfardini . | |
| 4,602,490 | 7/1986 | Glass et al. | 292/337 X |
| 4,682,482 | 7/1987 | Hall . | |
| 4,711,477 | 12/1987 | Fann et al. | 292/DIG. 60 X |

*Primary Examiner*—Eric K. Nicholson

*Attorney, Agent, or Firm*—Edgar A. Zarins; Malcolm L. Sutherland

[57] ABSTRACT

A door latch having an adjustable backset position which allows it to be used in doors having either a $2\frac{3}{8}''$ backset or a $2\frac{3}{4}''$ backset. The latch includes a cam which extends and retracts the latch bolt and has a rotational axis which is movable between the backset positions. The cam lever cooperates with a bolt extension which adjustably engages the bolt such that upon transposition of the cam lever, the bolt extension is adjusted relative to the bolt accordingly. A cam stabilizer plate prevents adjustment of the backset once the latch is installed.

23 Claims, 5 Drawing Sheets

BACKSET ADJUSTABLE DOOR LATCH

BACKGROUND OF THE INVENTION

I. Field of the Invention

This invention relates to door latches and, in particular, to a door latch having an adjustable backset to accommodate a specific door configuration.

II. Description Of The Prior Art

Typically, doors are provided with a standard backset which defines the distance between the rotational axis of the operating knob and the edge of the door from which the latch bolt extends. Most modern doors are provided with a backset of 2⅜" while older doors and a minority of modern doors have a backset of 2¾". Thus, if the door hardware needs to be replaced, the user must locate a door latch which has the identical backset. Accordingly, hardware suppliers must stock latches for both types of backsets.

Adjustable backset door latches have been developed which utilize various mechanisms to vary the distance between the door edge and the rotational axis of the latch knob. However, the available space within the door is limited and therefore the length of the latch must correspond to the door configuration. Several prior known latches with adjustable backsets employ telescopingly extendable mechanisms which required additional preparation of the door. Still other designs comprised complicated mechanisms which could not be cost-effectively manufactured or had an unacceptable failure rate.

SUMMARY OF THE PRESENT INVENTION

The present invention overcomes the disadvantages of the prior known door latches by providing a door latch readily adaptable to existing door configurations and which includes means for adjusting the backset thereof.

The adjustable backset door latch of the present invention includes an actuating cam lever having a rotational axis concentrically mounted with the rotational axis of the latch handle and which pivotally moves the latch bolt between the retracted and extend positions. Connected to the bolt is a bolt extension which engages the end of the cam. The bolt extension is selectively connected to the bolt by a spring-biased pin disposed within the bolt. The cam is pivotably connected to case halves which enclose the operating mechanism. A pivot lever is also pivotably connected to the case halves and extends between the cam and the spring-biased pin within the bolt. A cam stabilizer plate receives the axis of the actuating cam and travels with the cam as the backset is adjusted.

The case halves include a double recess opening adapted to selectively receive the rotational axis of the actuating cam. In a first recess, the cam will pivot at a first backset and in a second recess, the cam will pivot at the other backset. The actuating cam is prevented from inadvertently moving from one recess to the other by the stabilizer plate. When it is desired to change the backset of the latch the cam is moved from one recess to the other. As the cam is moved, the pivot lever will be engaged which will force the pin downward allowing the bolt extension to move longitudinally relative to the bolt as the cam is moved longitudinally. Once the actuating cam is in the other recess, the pivot lever will return to its at rest position and the spring will cause the pin to again connect the bolt extension to the bolt. Once the door latch is installed, the cam stabilizer plate will prevent movement of the cam.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
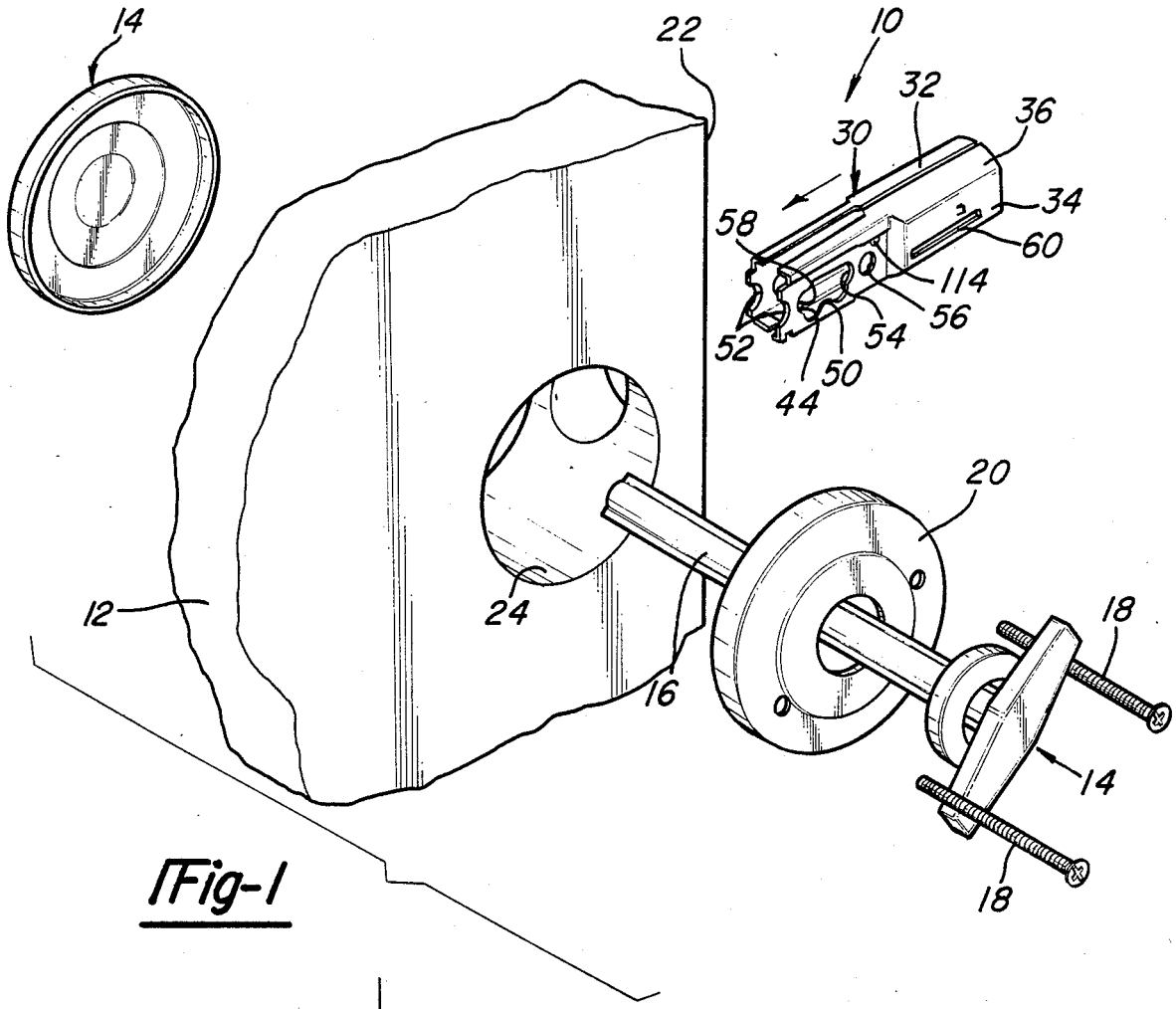
FIG. 1 is an exploded view of a door latch assembly in conjunction with a door and embodying the present invention.

Referring first to FIG. 1, there is shown a latching mechanism 10 embodying the present invention mountable within a door 12. The latching mechanism 10 includes an operating handle 14 for latching and unlatching the mechanism 10. The operating handle 14 may be in the form of a knob, a lever or a key lock and includes a rod 16 which forms the rotational axis of operating handle 14. A similar operating means may be provided on the other side of the door 12. The operating handle 14 and latching mechanism 10 are retained within the door 12 by mounting bolts 18 which extend through the cylinder plate 20 and the latching mechanism 10. The present invention provides a latching mechanism 10 whereby the backset distance between the door edge 22 and the rotational axis of the operating handle 14 can be selectively adjusted between a 2⅜" backset and a 2¾" backset. Since both old and new doors 12 may be provided with a throughbore 24 it is advantageous that the latching mechanism 10 can be altered to accommodate the positioning of the bore 24 relative to the door edge 22. The present invention includes two embodiments which allow simple adjustment of the backset of the latching mechanism. A first embodiment is shown in FIGS. 2 through 8 while a second embodiment is shown in FIGS. 9 through 15. Both embodiments operate in substantially the same manner and include many of the same components.

Figure 2:
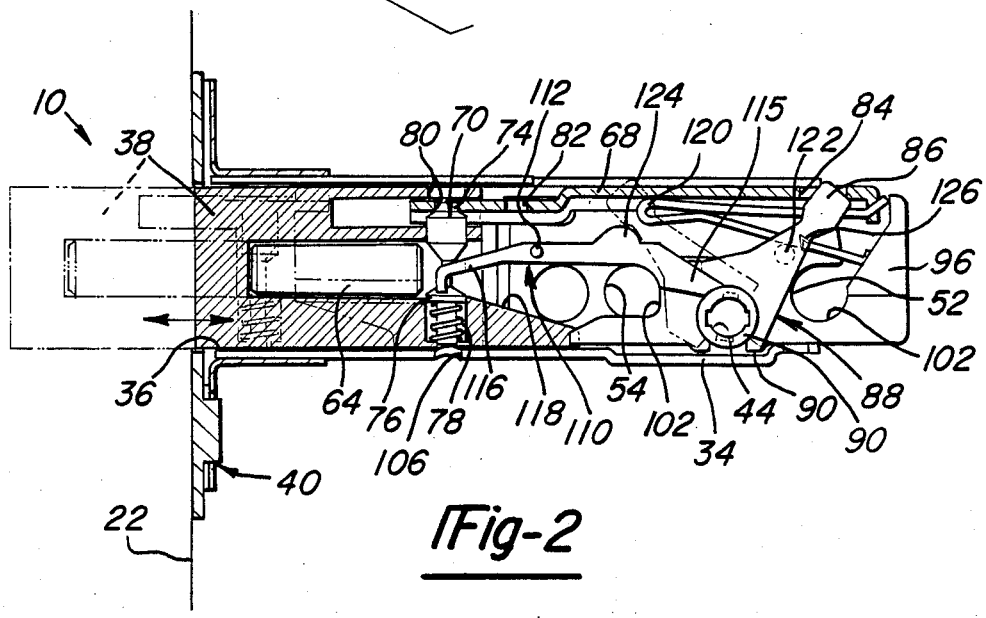
FIG. 2 is a cross-sectional perspective of a first embodiment of the lock assembly depicting the retracted bolt in solid and the extended bolt in phantom.
Figure 8:
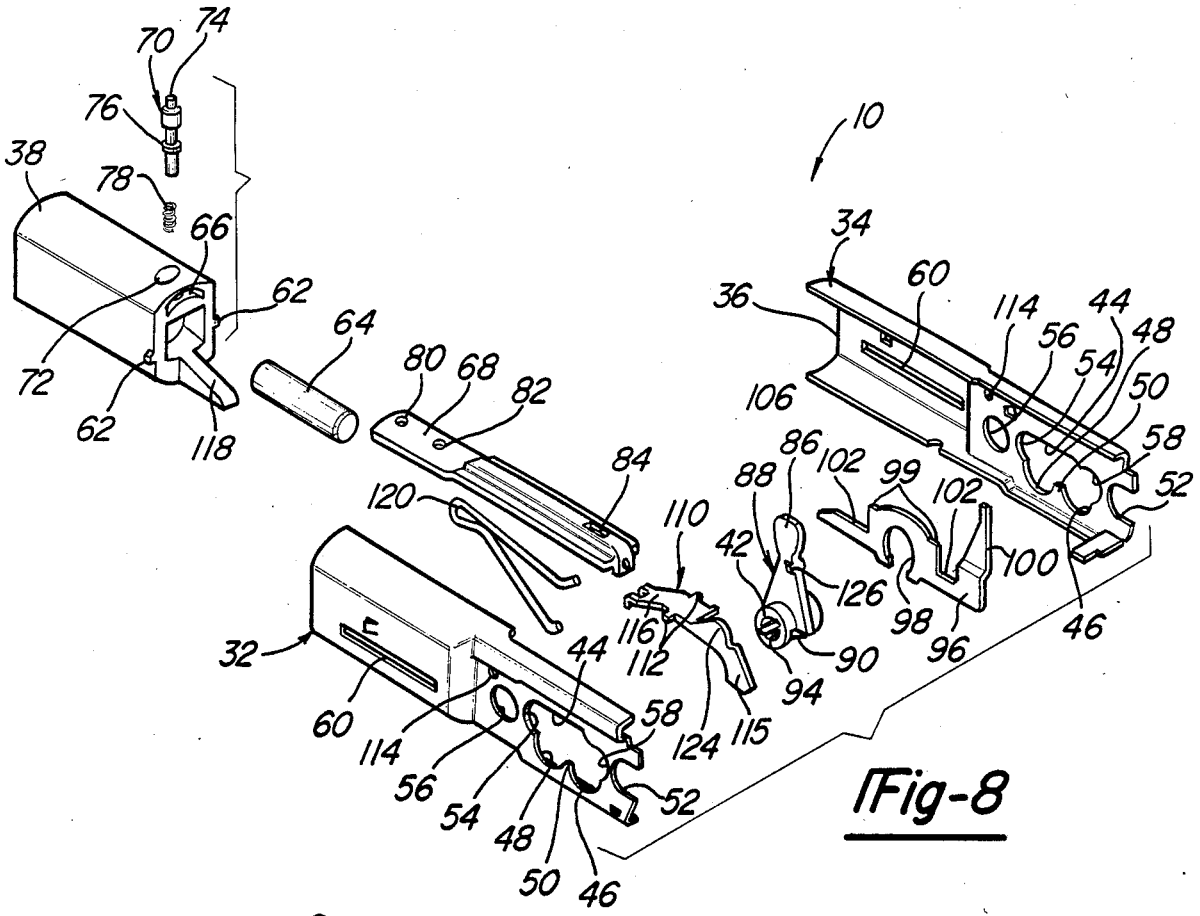
FIG. 8 is an exploded view of the first embodiment of the latch assembly of the present invention.

Referring now to FIGS. 2 and 8 of the drawings, the latching mechanism 10 includes a latch housing 30 adapted to retain and house the components of the mechanism 10 to facilitate assembly of the latch within the door 12. The latch housing 30 includes a pair of housing halves 32 and 34 adapted to be matingly assembled. The latch housing 30 includes at least one open end 36 through which a latch bolt 38 is slidably extended and retracted. To provide support of the assembled housing 30 and facilitate fixed mounting of the latch mechanism 10 within the outer edge 22 of the door 12, either a face plate assembly 40 or a drive-in collar 42 may be attached to the housing end 36 and secured to the door 12 in the appropriate manner. Once secured, the bolt 38 can be shifted between a retracted position (solid lines in FIG. 2) and an extended position (phantom lines in FIG. 2) to unlatch and latch the door 12, respectively.

The latch housing halves 32 and 34 include aligned openings 44 which controls the backset position of the operating handle 14 with respect to the latching mechanism 10. The aligned openings 44 include a first notch portion 46 and a second notch portion 48 with a dividing wall portion 50 of the housing 30 disposed therebetween. The dividing wall portion 50 is in the form of a cusp resulting from the semi-circular configuration of the notch portions 46 and 48. In a preferred embodiment of the present invention, additional openings are provided to receive the mounting bolts 18 through the latch housing 30 in order to fixedly mount the latch 10 within the door 12 depending upon the backset position of the latching mechanism 10. In a preferred configuration, notch 52 in the end of latch housing 30 cooperates with the end notch 54 of the opening 44 to form a first set of openings to receive the mounting bolts 18 in a first backset position while aperture 56 in the latch housing 30 cooperates with second end notch 58 of the opening 44 to form a second set of openings to receive the mounting bolts 18 in a second backset position.

The latch housing halves 32 and 34 further include longitudinal grooves 60 adapted to matingly receive flanges 62 formed on opposite sides of the bolt 38 to maintain alignment of the bolt 38 and prevent excessive retraction or extension. Positionally captured within the bolt 38 is a security roller 64 to prevent the bolt 38 from being cut. At its upper end, the bolt 38 includes an elongated slot 66 adapted to receive a bolt extension 68. The bolt extension 68 is adjustably connected to the bolt 38 by a connector pin 70 movably disposed within a vertical bore 72 of the bolt 38. The connector pin 70 includes a reduced diameter pin head 74 and an annular shoulder 76 formed on the lower half of the pin 70. The pin 70 is biased upwardly by a spring 78 positioned within the bore 72 between the annular shoulder 76 of the pin 70 and the bottom of the bore 72. The connector pin 70 adjustably connects the bolt extension 68 to the bolt 38 for mutual reciprocal movement through a plurality of openings formed in the bolt extension 68. The bolt extension 68 includes a first opening 80 and a second opening 82 adapted to receive the pin head 74 and position the bolt extension 68 relative to the bolt 38 for the first and second backset positions, respectively. The pin 70 is moved between the first opening 80 and the second opening 82 as the latching mechanism 10 is moved between the first backset position and the second backset position as will be subsequently described.

At the opposite end of the bolt extension 68 from the openings 80 and 82 is a rectangular opening 84 adapted to receive the head 86 of an actuating cam 88 which operates on the bolt extension 68 to shift the bolt 38 between the extended and retracted positions. The actuating cam 88 includes a lower camming surface 90 proximate a hub 92 about which the actuating cam 88 cams or rotates. The hub 92 has a hub bore 94 configured to receive the operating rod 16 such that as the operating handle 14 is rotated the hub 92 and the actuating cam 88 will be rotated accordingly for operation of the latching mechanism 10 as will be subsequently described. The hub 92 of the actuating cam 88 is retained by a retaining plate 96 having an opening 98 to receive one end of the hub 92. The retaining plate 96 moves with the actuating cam 88 during adjustment of the backset. Shoulders 99 on the retaining plate 96 act as stops to prevent the cam 88 from over rotating prior to installation within the door 12. In prior known latches, the stops were built into the housing. However, because of the adjustable backset of the present invention the stops were incorporated into the plate 96 which moves with the cam 88. The retaining plate 96 preferably has an upwardly extending arm 100 which engages the end of the bolt extension 68 and helps to push the bolt extension 68 forward when the backset is adjusted from 2¾" to 2⅜". The retaining plate 96 also includes a pair of semi-circular removed portions 102 on opposite sides of the aperture 98 for receiving the mounting bolts 18 thereby preventing movement of the retaining plate 96 and actuating cam 88 between backset positions once the mounting bolts 18 are positioned through the latching mechanism 10.

Engaging the actuating cam 88 and attached to the housing halves 32 and 34 is a pivot lever 110. The pivot lever 110 includes a pair of intermediate tabs 112 which are received in openings 114 in the housing halves 32 and 34 and about which the lever 110 pivots. The pivot lever 110 has a first end 115 adapted to engage the actuating cam 88 and a second end 116 adapted to engage the connector pin 70. In a preferred embodiment, the first end 115 has a wedged configuration and adjustably engages the hub 92 of the actuating cam 88 while the second end 116 is forked and engages the top of the annular shoulder 76 of the pin 70. The lever 110 is designed to pivot as the actuating cam 88 is moved between backset positions such that the pin 70 will be depressed against the force of the spring 78 as will be subsequently described. The forked end 116 of the pivot lever 110 is also configured to travel along a ramped surface 118 formed as part of the bolt 38 as the bolt 38 moves between the retracted and extended position.

In the first embodiment of the present invention shown in FIGS. 2–8, a cam spring 120 is attached to the end of the bolt extension 68 and is carried therewith as the extension 68 travels longitudinally through the housing 30. The cam spring 120 engages the actuating cam 88, preferably at spring post 122 formed on one side of the actuating cam 88, to facilitate extension and retraction of the bolt 38 upon rotation of the actuating cam 88. The spring post 122 also engages the shoulder stops 99 of the retaining plate 96 to prevent over rotation of the cam 88. Furthermore, the pivot lever 110 includes a hump 124 which selectively engages a triangular protrusion 126 on the cam 88. As best shown in FIG. 2, the protrusion 126 and hump 124 cooperate in the bolt extended position (phantom) to prevent the cam 88 from being moved longitudinally rearward to a different backset. This ensures that the backset can be changed only when the bolt 38 is retracted to ensure proper alignment of all components as will be subsequently described.

In the second embodiment of the present invention, the retaining plate 96 includes a tab 130 formed perpendicular to the body of the plate 96 at the end thereof to which the cam spring 220 is attached. Accordingly, the cam spring 220 travels with the retaining plate 96 during adjustment of the backset. As in the first embodiment, the cam spring 220 engages the spring post 122 to aid in retraction and extension of the bolt 38 as the cam is pivoted. Moreover, in the second embodiment, the pivot lever 110 does not include a hump and the actuating cam 88 does not include the triangular protrusion.

The latching mechanism 10 of the present invention allows the adjustment of the backset distance between the door edge 22 and the rotational axis of the operating handle 14 in order to install the latch on prepared doors of different configurations. In the most common adjustment, the present latching mechanism 10 can be adjusted between a $2\frac{3}{4}''$ backset and a $2\frac{3}{8}''$ backset. Both embodiments operate to adjust the backset in substantially the same manner and therefore will be simultaneously described. Referring to FIGS. 3–7 for the first embodiment and to FIGS. 11–15 for the second embodiment there is shown the steps for adjusting the backset from a first backset position to a second backset position.

Figure 3:
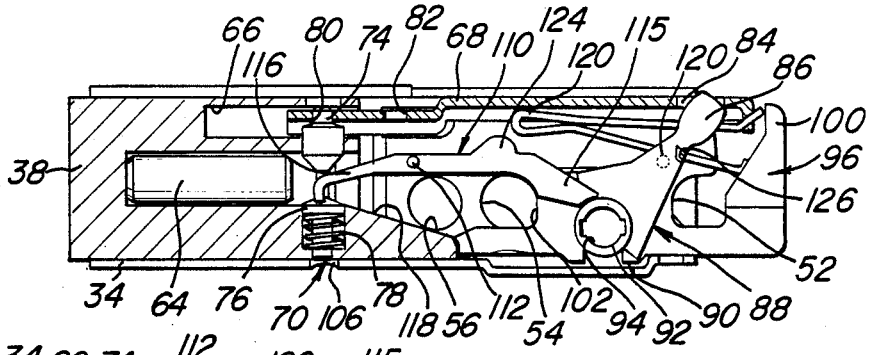
FIGS. 3 through 7 are progressive, cross-sectional illustrations of the first embodiment of the latch assembly being adjusted from one backset position to another backset position.
Figure 4:
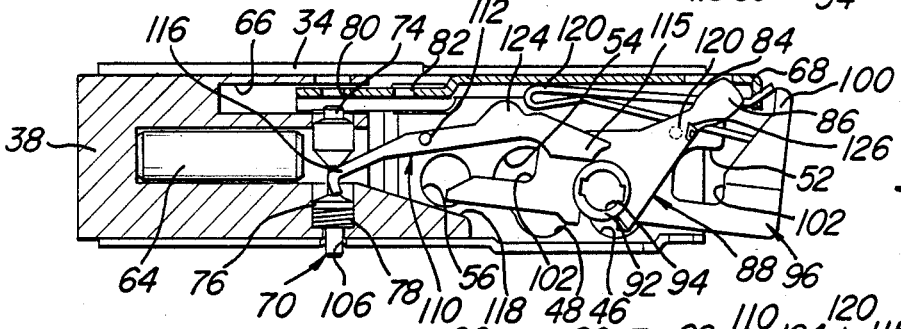
Figure 5:
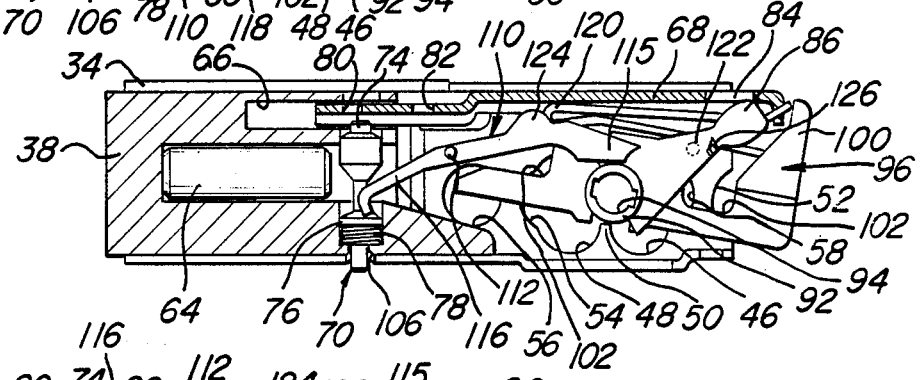
Figure 6:
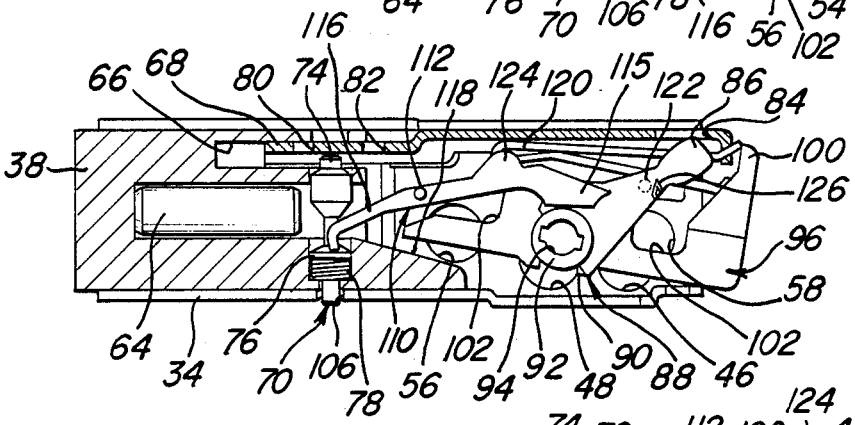
Figure 7:
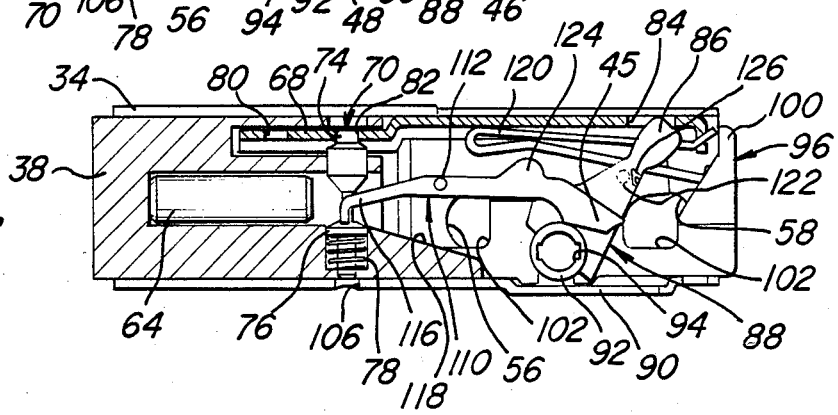
Figure 11:
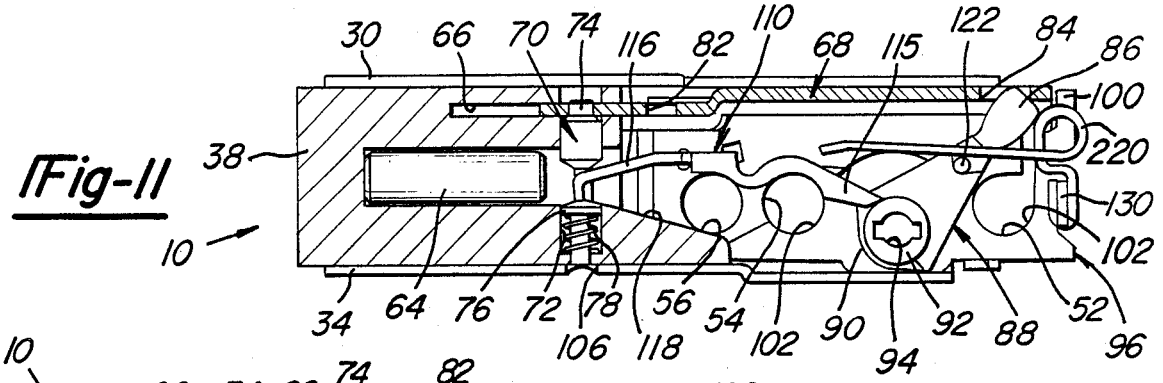
FIGS. 11 through 15 are progressive, cross-sectional illustrations of the second embodiment of the latch assembly being adjusted from one backset position to another backset position.
Figure 12:
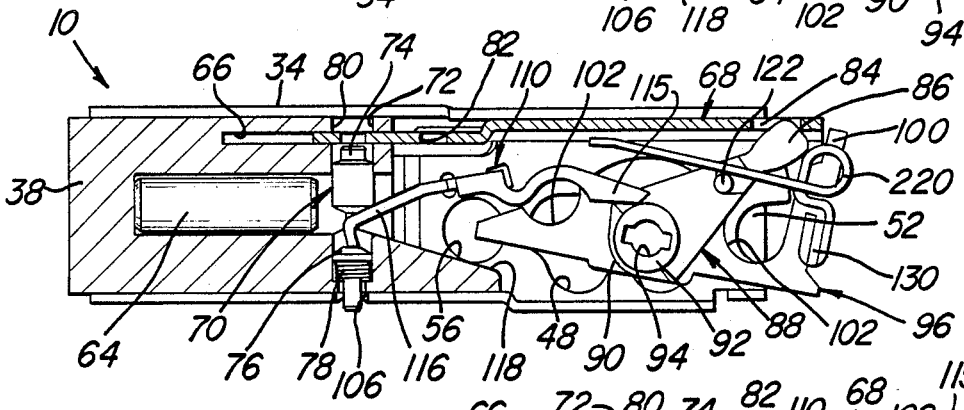
Figure 13:
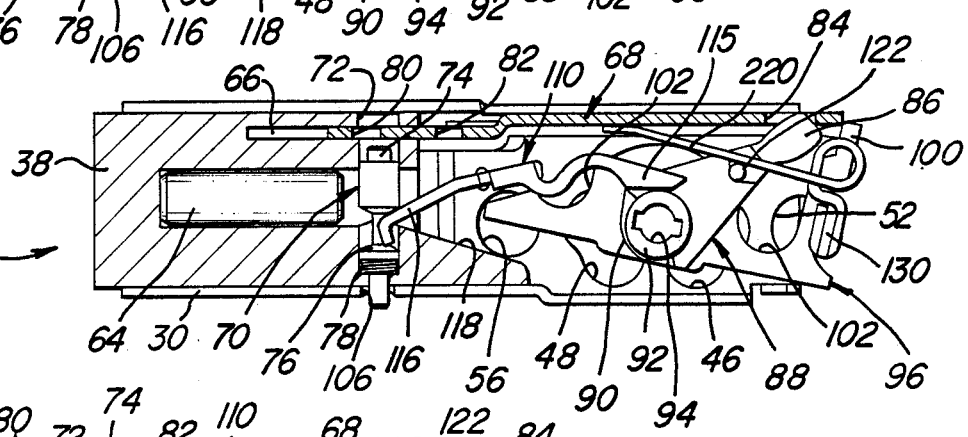
Figure 14:
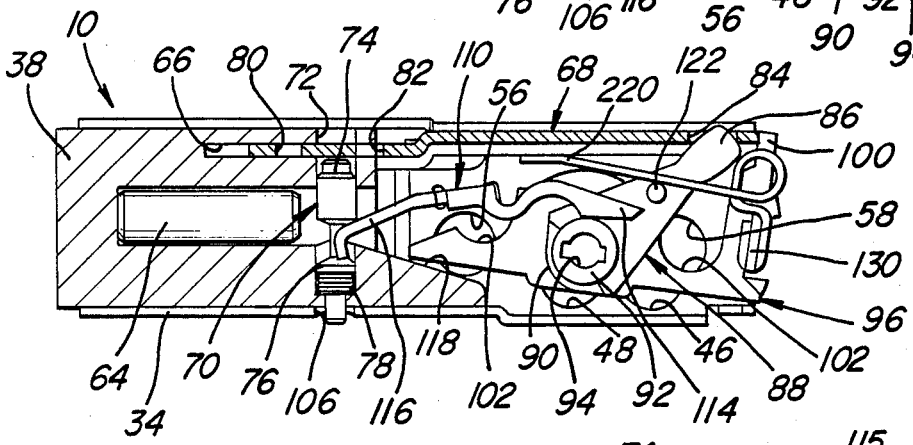
Figure 15:
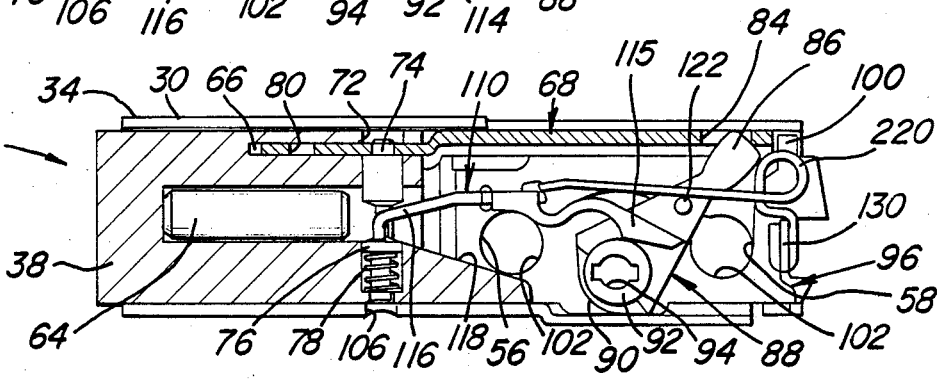

Backset adjustment is conducted prior to installing the latching mechanism 10 within the door and with the bolt 38 fully retracted within the housing 30. In this position, the actuating cam 88 is pivoted towards the rear of the latch housing 30 and the forked end 116 of the pivot lever 110 engages the annular shoulder 76 of the connector pin 70. By way of example, the hub 92 of the actuating cam 88 is positioned in the first notch portion 46 of the opening 44 in the housing halves 32 and 34 while the head 74 of pin 70 engages first opening 80 of the bolt extension 68 (FIGS. 3 and 11). However, it is to be understood that the latching mechanism 10 may begin in the second backset position (FIGS. 7 and 15) in which case the steps for adjustment will be reversed.

With the bolt 38 fully retracted into the housing 30 adjustment of the backset is accomplished by moving the hub 92 of the actuating cam 88 from the first notched portion 46 to the second notched portion 48. As the hub 92 is moved over the dividing wall 50 the hub 92 will pivot the first end 115 of the pivot lever 110 upwardly causing the second end 116 of the lever 110 to pivot downwardly against the shoulder 76 of the connector pin 70. As the connector pin 70 is depressed against the force of the spring 78 the lower end of the pin 70 will extend into an aligned aperture 106 in the housing 30 preventing the bolt 38 from moving longitudinally within the housing 30. Simultaneously, the pin head 74 will be retracted from the first opening 80 in the bolt extension 68 disconnecting the bolt extension 68 from the bolt 38. As the actuating cam 88 and the attached retaining plate 96 are moved forwardly over the dividing wall portion 50 between notches 46 and 48 of the opening 44, the arm 100 of the retaining plate 96 and the positioning of the cam head 86 within the opening 84 of the bolt extension 68 will cause the bolt extension 68 to move further into the slot 66 relative to the bolt 38. Once the hub 92 of the actuating cam 88 falls into second notch portion 48, the lever 110 will be free to pivot back to its original position. The spring 78 biases the pin 70 upwardly against the lever 110 causing the pivot lever 110 to return to its original position. Simultaneously, the bottom end of the pin 70 will be withdrawn from the aperture 106 while the pin head 74 will extend into second opening 82 in the bolt extension 68 to again connect the extension 68 to the bolt 38 for reciprocal movement therewith.

With the backset now adjusted as required, the latching mechanism 10 can be installed within the door 12 for operation using the operating handle 14. With either the face plate assembly 40 or the drive-in collar 42 attached to the housing 30, the latching mechanism 10 is placed through the appropriate opening formed in the edge 22 of the door 12. The operating rod 16 is extended into the bore 24 and through the hub bore 94 for operation of the actuating cam 88. The mounting bolts 18 are then positioned through the openings in the cylinder plate 20 and the appropriate openings of the latching mechanism 10. With the latching mechanism 10 positioned in the first backset (FIGS. 3 and 11), the mounting bolts 18 will extend through the first set of apertures formed by notches 52 and 54 of the housing halves (32,34) and semi-circular removed portions 102 of the retaining plate 96. With the latching mechanism 10 positioned in the second backset (FIGS. 7 and 15), the mounting bolts will extend through the second set of apertures formed by the removed portions 102 of the retaining plate 96 and openings 56 and 58 of the housing halves (32, 34). The mounting bolts 18 will prevent the retaining plate 96 from being moved. Since the actuating cam 88 is connected to the retaining plate 96, once the mounting bolts 18 are placed through the latching mechanism 10 the backset cannot be adjusted.

Figure 9:
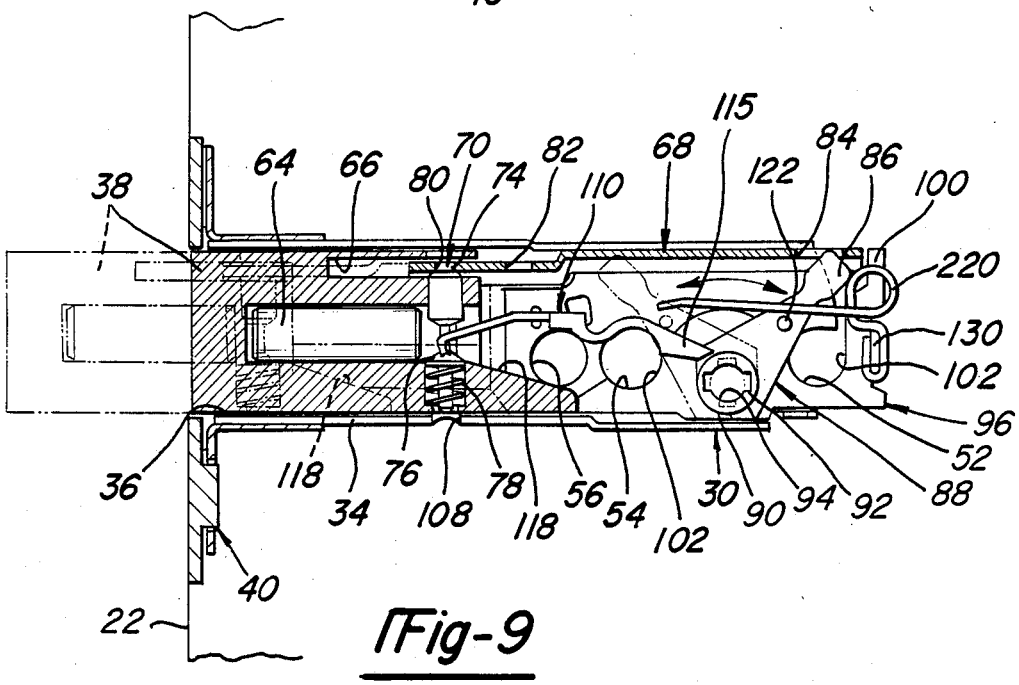
FIG. 9 is a cross-sectional perspective of a second embodiment of the lock assembly depicting the retracted bolt in solid and the extended bolt in phantom.
Figure 10:
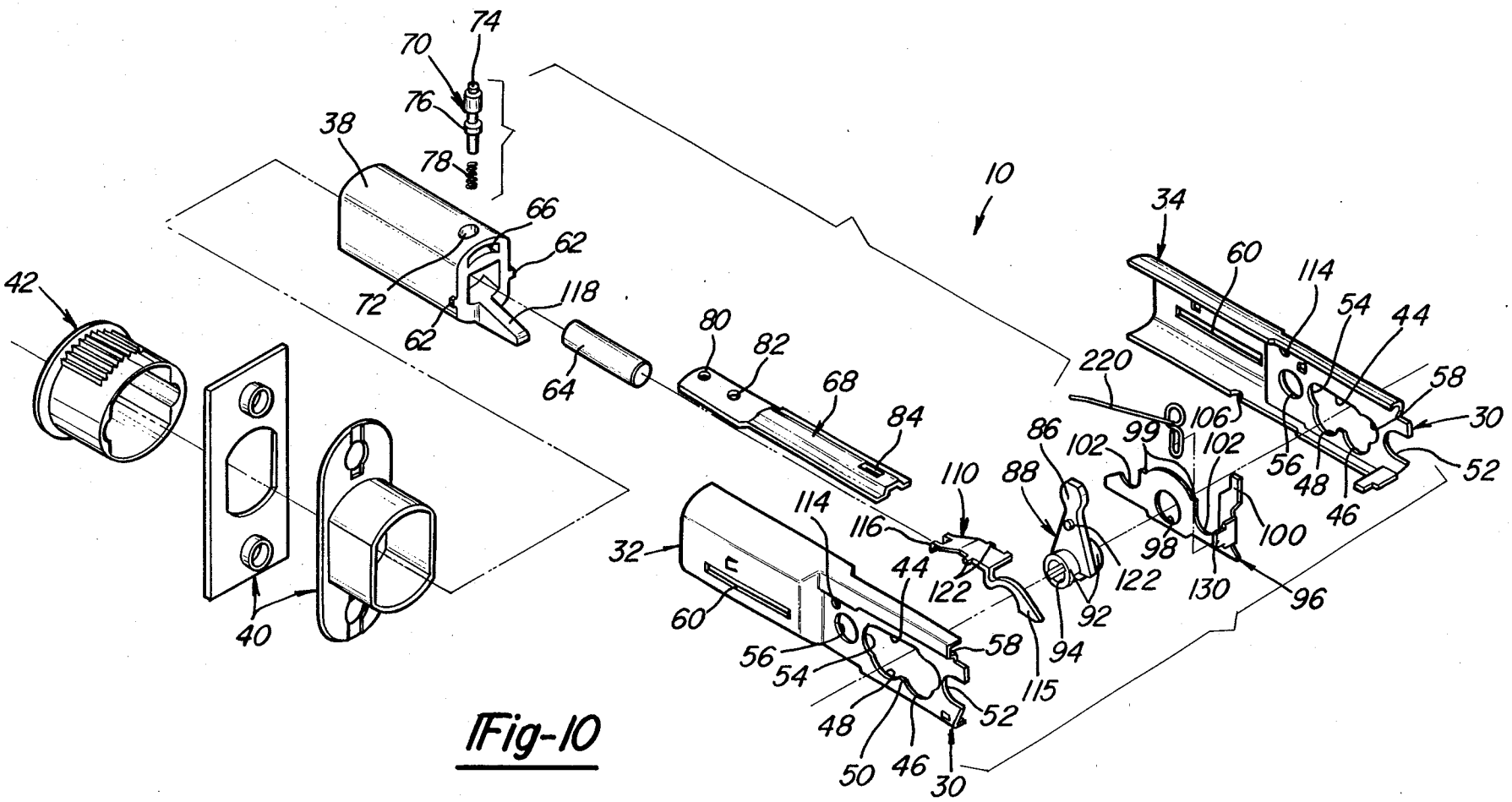
FIG. 10 is an exploded view of the second embodiment of the latch assembly of the present invention.

Once the latching mechanism 10 is installed within the door 12, rotation of the operating handle 14 will shift the bolt 38 between a retracted position shown in solid in FIGS. 2 and 9 and an extended position shown in phantom in FIGS. 2 and 9. As the operating handle 14 is rotated, rod 16 will cause the hub 92 to rotate and the actuating cam 88 to pivot accordingly. The actuating cam 88 operates on the bolt extension 68 for shifting the bolt 38 between the extended and retracted positions. As bolt 38 extends from the housing 30, the pin 70 will travel with the bolt 38 causing the lever 110 to disengage from the shoulder 76 of the pin 70. This prevents the backset to be changed with the bolt 38 extended even when the mechanism is not mounted in the door. However, to ensure that the backset can be again altered and to prevent jamming, as the bolt 38 is retracted into the door 12, the second end 116 of the pivot lever 110 will travel up along the ramp 118 into the bolt 38 to re-engage the pin 70. Retraction of the bolt 38 is accomplished simply by rotating the handle 14 in the opposite direction causing the actuating cam 88 to draw the bolt extension 68 and the bolt 38 into the housing 30. In the first embodiment the cam spring 120 will travel with the bolt extension 68 to which it is attached while remaining in contact with the pin 122 of the actuating cam. In addition, when the bolt 38 is extended and therefore the actuating cam 88 is pivoted toward the bolt 38, the triangular protrusion 126 engages the hump 124 of the pivot lever 110. This further ensures that the backset cannot be adjusted unless the bolt 38 is retracted to eliminate misalignment of the components. Such a feature is particularly important when the latch mechanism 10 is not mounted within the door 12. Thus, the present invention provides a simple device for latching a door which can be accommodated to doors having different backsets.

The foregoing detailed description has been given for clearness of understanding only and no unnecessary limitations should be understood therefrom as some modifications will be obvious to those skilled in the art without departing from the scope and spirit of the appended claims.

I claim:

1. A latching mechanism mountable within a door and having a rotatable operating handle, the door having an outer edge through which said mechanism extends, said latching mechanism having an adjustable backset distance between the door edge and the rotational axis of the operating handle, said latching mechanism comprising:

a bolt shiftable between extended and retracted positions;

a bolt extension adjustably connected to said bolt and shiftable with said bolt;

an actuating cam operating on said bolt extension for shifting said bolt between the extended and retracted positions, said cam having a pivot hub coaxial with the rotational axis of the operating handle;

a latch housing having an opening to rotatably receive said hub of said actuating cam;

said hub of said actuating cam receivable in a first portion of said opening such that the rotational axis of the operating handle is positioned in a first backset position relative to the door edge, said bolt extension engaging said bolt in a first relative position;

said hub of said actuating cam receivable in a second portion of said opening such that the rotational axis of the operating handle is positioned in a second backset position relative to the door edge, said bolt extension connected to said bolt in a second relative position;

said actuating cam selectively movable between said first and second portions of said housing opening to adjust the backset distance of said latching mechanism; and means selectively connecting said bolt to said bolt extension whereby said bolt extension can be adjusted between said first and second positions relative to said bolt, said means operatively engaging said actuating cam such that as said cam is moved between said first and second portions of said housing opening said means disconnects said bolt from said bolt extension for relative adjustment between said first and second positions.

2. The latching mechanism as defined in claim 1 wherein said latch housing includes a pair of cooperable housing halves joined to house said actuating cam, said bolt and said bolt extension, each of said housing halves having an opening with said first and second portions to receive said hub of said actuating cam.

3. The latching mechanism as defined in claim 2 wherein said latch housing includes first and second apertures for receiving the mounting bolts of the operating handle to secure said latching mechanism within the door, the mounting bolts received in said first apertures when the operating handle is positioned in said first backset position of said latching mechanism and the mounting bolts received in said second apertures when the operating handle is in said second backset position of said latching mechanism.

4. The latching mechanism as defined in claim 3 and further comprising a retaining plate having an aperture to receive said hub of said actuating cam, said retaining plate preventing movement of said hub of said actuating cam between said first portion and said second portion of said housing opening when the mounting bolts extend through said latch housing.

5. The latching mechanism as defined in claim 4 wherein said bolt extension has a cam spring secured thereto, said cam spring engaging said actuating cam.

6. The latching mechanism as defined in claim 4 wherein said retaining plate has a cam spring secured thereto, said cam spring engaging said actuating cam.

7. The latching mechanism as defined in claim 2 wherein said connecting means comprises a pivot lever pivotally attached to said housing halves and a spring-biased pin disposed within said bolt, said pivot lever having first and second ends, said first end engaging said hub of said actuating cam.

8. The latching mechanism as defined in claim 7 wherein said bolt is selectively connected to said bolt extension by said spring-biased pin disposed within said bolt, said pin extending into a first opening in said bolt extension to connect said bolt to said bolt extension when said actuating cam is in said second portion of said housing opening.

9. The latching mechanism as defined in claim 8 wherein said second end of said pivot lever engages said pin, said pivot lever selectively withdrawing said pin to allow movement of said bolt extension relative said bolt.

10. The latching mechanism as defined in claim 9 wherein said opening in said housing halves includes a divider formed from the wall of said housing halves between said first and second portions of said opening, said hub moving over said divider as said actuating cam is moved between said first and second portion of said opening.

11. The latching mechanism as defined in claim 10 wherein said second end of said pivot lever is forked to engage said pin, said pivot lever pivoting as said hub of said actuating cam moves over said divider to move said actuating cam between said first and said second portion of said opening thereby moving said pin downward to withdraw said pin from said bolt extension.

12. The latching mechanism as defined in claim 11 wherein said pivot lever and said actuating cam include cooperating means for preventing movement of said hub of said actuating cam between said first and second portion of said opening when said bolt is in said extended position.

13. A latching mechanism mountable within a door and having a rotatable operating handle, the door having an outer edge through which said mechanism extends, said latching mechanism having an adjustable backset distance between the door edge and the rotational axis of the operating handle, said latching mechanism comprising:

a bolt shiftable between extended and retracted positions;

a bolt extension adjustably connected to said bolt and shiftable with said bolt, said bolt extension selectively adjustable between a first position and a second position relative to said bolt;

an actuating cam operating on said bolt extension for shifting said bolt between the extended and retracted positions, said cam having a pivot hub coaxial with the rotational axis of the operating handle;

a latch housing having an opening to rotatably receive said hub of said actuating cam, said opening including a first notch portion and a second notch portion having a dividing wall portion of said housing disposed therebetween, said hub of said actuating cam selectively movable between said first notch portion and said second notch portion;

a pivot lever pivotably connected to said latch housing and having first and second ends, said first end engaging said hub of said actuating cam, said lever pivoting as said actuating cam is moved between said first and second notch portions of said opening; and a connector pin disposed within said bolt and selectively engageable with said bolt extension, said second end of said pivot lever engaging said pin;

said hub of said actuating cam receivable in said first portion of said opening such that the rotational axis of the operating handle is positioned in a first backset position relative to the door edge, said bolt extension engaging said bolt in a first relative position;

said hub of said actuating cam receivable in a second portion of said opening such that the rotational axis of the operating handle is positioned in a second backset position relative to the door edge, said bolt extension engaging said bolt in a second relative position;

said actuating cam selectively movable between said first and second portions of said housing opening to adjust the backset distance of said latching mechanism.

14. The latching mechanism as defined in claim 13 wherein said latch housing includes a pair of cooperable housing halves joined to house said mechanism, each of said housing halves including said opening with said first and second notch portions, said openings in said housing halves receiving opposite ends of said hub of said actuating cam.

15. The latching mechanism as defined in claim 14 wherein said latch housing includes first and second sets of apertures for receiving the mounting bolts of the operating handle to secure said latching mechanism within the door, the mounting bolts received in said first set of apertures when the operating handle is positioned in said first backset position of said latching mechanism and the mounting bolts received in said second set of apertures when the operating handle is in said second backset position of said latching mechanism.

16. The latching mechanism as defined in claim 15 and further comprising a retaining plate disposed within said latch housing and attached to said actuating cam, said retaining plate preventing movement of said hub of said actuating cam between said first notch portion and said second notch portion of said housing opening when the mounting bolts extend through said latch housing.

17. The latching mechanism as defined in claim 16 wherein said retaining plate has a cam spring secured thereto, said cam spring biasingly engaging said actuating cam.

18. The latching mechanism as defined in claim 16 wherein said bolt extension has a cam spring secured thereto, said cam spring engaging said actuating cam.

19. The latching mechanism as defined in claim 13 wherein said connector pin is spring-biased towards engagement with said bolt extension within said bolt, said pin extending into a first opening in said bolt extension to connect said bolt to said bolt extension when said actuating cam is in said first notch portion of said housing opening and said pin extending into a second opening in said bolt extension to connect said bolt to said bolt extension when said actuating cam is in said second notch portion of said housing opening.

20. The latching mechanism as defined in claim 19 wherein said connector pin includes an annular shoulder, said shoulder positionally maintaining said pin spring while providing an engagement surface for said second end of said pivot lever, said pivot lever acting against the biasing force of said spring to retract said pin from said bolt extension to allow movement of said bolt extension relative said bolt, said pivot lever pivoting as said hub of said actuating cam moves over said dividing wall portion between said first and second notch portions thereby moving said pin downward to withdraw said pin from said bolt extension.

21. The latching mechanism as defined in claim 13 wherein said pivot lever and said actuating cam include cooperating means for preventing movement of said hub of said actuating cam between said first and second portions of said opening when said bolt is in said extended position.

22. In a latching mechanism mountable within a door and having a housing, a bolt shiftable between extended and retracted positions, a bolt extension mounted within the housing connected to the bolt, an actuating cam operating on said bolt extension for shifting said bolt between the extended and retracted positions, an operating handle for actuating said latching mechanism and having a rotatable rod which extends through the hub of said actuating cam for rotation thereof, the improvement comprising:

pin means within the bolt and selectively engageable with the bolt extension to adjustably connect the bolt extension to the bolt;

aligned openings on opposite sides of the latch housing through which the handle rod extends to engage the actuating cam, said openings having a first notch portion and a second notch portion with a divider wall disposed therebetween, the hub of the actuating cam selectively movable between said first notch portion and said second notch portion to adjust the backset distance between the rotational axis of the operating handle and the door edge;

a retaining plate disposed within the latch housing to prevent movement of the actuating cam between said first notch portion and said second notch portion when said latching mechanism is mounted within the door; and means for selectively retracting said pin means from the bolt extension for adjustment of the bolt extension relative to the bolt;

wherein the actuating cam is movable between said first notch portion and said second notch portion of the housing openings as the bolt extension is adjusted relative to the bolt for selectively adjusting the backset distance, said retracting means including a lever pivotally connected to the latch housing, said lever having a first end engaging the hub of the actuating cam and a second end engaging said pin means such that as the hub of the actuating cam is moved between said first and second notch portions said lever depresses said pin means for selective adjustment of the bolt extension relative to the bolt.

23. The latching mechanism as defined in claim 22 wherein said retaining plate includes an intermediate opening for receiving the hub of the actuating cam and other openings for receiving the mounting bolts of said latching mechanism, the mounting bolts engaging said retaining plate for preventing movement of said actuating cam between said first and second notch positions.

* * * * *